US008459668B2

(12) United States Patent
Yoon

(10) Patent No.: US 8,459,668 B2
(45) Date of Patent: Jun. 11, 2013

(54) SKATEBOARD

(76) Inventor: Eem Sik Yoon, Seoul (KR)

( * ) Notice: Subject to any disclaimer, the term of this patent is extended or adjusted under 35 U.S.C. 154(b) by 152 days.

(21) Appl. No.: 13/058,258

(22) PCT Filed: Jun. 4, 2009

(86) PCT No.: PCT/KR2009/002975

§ 371 (c)(1),
(2), (4) Date: Feb. 10, 2011

(87) PCT Pub. No.: WO2010/018921

PCT Pub. Date: Feb. 18, 2010

(65) Prior Publication Data

US 2011/0140386 A1 Jun. 16, 2011

(30) Foreign Application Priority Data

Aug. 11, 2008 (KR) ..... 10-2008-0078534

(51) Int. Cl.
*B62M 1/00* (2010.01)

(52) U.S. Cl.
USPC ..... 280/87.042; 280/87.05

(58) Field of Classification Search
USPC ..... 280/87.041, 87.042, 87.05, 87.01, 280/87.021, 87.03, 87.043, 638
See application file for complete search history.

(56) References Cited

U.S. PATENT DOCUMENTS

| | | | | |
|---|---|---|---|---|
| 4,082,306 | A * | 4/1978 | Sheldon | 280/87.042 |
| 7,195,259 | B2 * | 3/2007 | Gang | 280/87.042 |
| 7,325,819 | B2 * | 2/2008 | Kwak | 280/87.042 |
| 7,367,572 | B2 * | 5/2008 | Jiang | 280/87.042 |
| 7,775,534 | B2 * | 8/2010 | Chen et al. | 280/87.042 |
| 8,047,556 | B2 * | 11/2011 | Jang et al. | 280/87.042 |
| 8,118,319 | B2 * | 2/2012 | Hsieh | 280/87.042 |
| 2007/0257459 | A1 * | 11/2007 | Gang | 280/87.042 |
| 2007/0273118 | A1 * | 11/2007 | Conrad | 280/87.042 |
| 2009/0045598 | A1 * | 2/2009 | Lee | 280/87.042 |
| 2009/0066150 | A1 * | 3/2009 | O'Rourke, Sr. | 301/5.23 |
| 2009/0315290 | A1 * | 12/2009 | Vanounou | 280/87.042 |
| 2011/0131759 | A1 * | 6/2011 | An | 16/250 |
| 2012/0018969 | A1 * | 1/2012 | Cho | 280/87.041 |

FOREIGN PATENT DOCUMENTS

| | | | |
|---|---|---|---|
| KR | 10-0394848 | B1 | 8/2003 |
| KR | 20-0400315 | Y1 | 11/2005 |
| KR | 10-2006-0028948 | A | 4/2006 |
| KR | 10-0576306 | B1 | 4/2006 |
| KR | 10-0711650 | B1 | 4/2007 |
| KR | 10-2008-0025907 | A | 3/2008 |
| KR | 10-0885506 | * | 2/2009 |
| WO | WO 2007117125 | A1 * | 10/2007 |

* cited by examiner

*Primary Examiner* — John Walters
(74) *Attorney, Agent, or Firm* — LRK Patent Law Firm

(57) ABSTRACT

A skateboard is provided which includes a front board and a rear board that are connected at a predetermined distance and casters fixed to the bottoms of the boards, in which a hollow cover body is fitted in assembly holes and of housings and formed beneath the bottoms of the front board and the rear board, a first propeller shaft fitted in the assembly hole at the front board and a second propeller shaft fitted in the assembly board at the rear board are inserted in the hollow cover body in contact with each other by cam-shaped joint portions, and the first and second propeller shafts horizontally and elastically expand/contract in rolling motion of the front board and the rear board.

4 Claims, 5 Drawing Sheets

SKATEBOARD

CROSS REFERENCE TO RELATED APPLICATION

This application is a National Stage of International Application No. PCT/KR2009/002975 filed Jun. 4, 2009, claiming priority based on Korean Patent Application No. 10-2008-0078534 filed Aug. 11, 2008, the content of which is incorporated herein by reference in its entirety.

TECHNICAL FIELD

The present invention relates to a skateboard, in more detail, a skateboard that can elastically expand/contract straight by cam operation generated by first and second propeller shafts divided in a hollow cover disposed between a front board and a rear board.

BACKGROUND ART

As shown in FIG. 1, a typical skateboard 10 is composed of a long elliptical plate 11 and two pairs of wheels 12A and 12B fixed to the bottom of the plate 11. The pairs of wheels 12A and 12B each have two rollers.

In general, a rider on the skateboard 10 propels it by pushing the ground with one foot when traveling on a flatland, and inclines the skateboard 10 to the left or right with respect to the traveling direction with feet to turn while traveling.

However, since the rider have to push the ground with foot every time to propel the board, he/she loses an interest in driving, and a safety accident may occurs when the rider is unfamiliar with steering. Further, it is difficult for unskilled riders to try turning in traveling and there is a large possibility that a rider falls down when the skateboard is inclined more than a predetermined degree to the sides.

Accordingly, Korean Patent Registration No. 0394848 discloses a skateboard that can be propelled only by twist of the rider's body and turn with a small radius of curvature in traveling.

That is, as show in FIG. 2, the skateboard 20 is composed of two boards, that is, a front board and a rear board 21A and 21B, directional casters 22A and 22B fixed at an angle to the bottom of the boards 21A and 21B, a torsion pipe 23 connecting the boards 21A and 22B and having an elastic built-in member for restoration against torsion and bending, and fastening members 24 fixing the pipe 23.

Further, the torsion pipe 23, as shown in FIGS. 3 and 4, two pipes, front and rear pipes 25A and 25B are connected with each other by a bearing 26, such that they can idle with respect to each other. A spring 27*a* and a locker 27*b* are provided at an end of an inner pipe 25C disposed inside the pipe 25B. A leaf spring 28 is provided inside the inner pipe 25C and fixed in a holder 29 by a screw 29*a*.

Therefore, elastic deformation occurs by relative torsional motion between the front and rear pipes while the boards travel, and the torsion pipe 23 restores when the torsional external force is removed. Accordingly, the front board 21A and the rear board 21B make wave-shaped motion while elastically rolling in the opposite directions. The skateboard can be moved forward by this motion of the front board 21A and the rear board 21B.

However, the skateboard has a problem that workability is deteriorated, because it needs many parts, including a plurality of pipes for connecting both boards, a bearing disposed between the pipe, and a locker and a spring for preventing idling.

Further, a rider has to twist his/her body left and right on the board to generate propulsive force. Accordingly, large external torsion force is exerted in the joints of the parts, such that they are broken by cracks. Further, a rider has a difficult in balancing both boards due to decrepitude of the leaf spring by use for a long period of time, which makes it to ride the skateboard. Since the propulsive force is generated by the rolling motion of both boards, it is difficult to generate propulsive for that can satisfies the rider.

On the other hand, the applicant(s) of the present invention had repeatedly studied on the basis of the relate arts described above, and as disclosed in Korean Paten Registration No. 0576306, has been granted a patent about a "skateboard", which includes a front board and a rear board equipped with a caster, a center connecting portion that combine the boards, a support means inserted in a hole formed in the center connecting portion, hinge means and fastening means fixed to the upper and lower portion of the center connecting portions. Further, patentability has been recognized for a "skate board equipped with a brake system", which can be easily braked by a brake system disposed at the center between both boards, as disclosed in Korean Patent Publication No. 2008-0025907.

In those skateboards have the advantage of allowing a rider to easily keep his/her balance on both boards and smoothly travel at a sharp curve. Further, a rider can easily carry the skateboards and easily brake them traveling. However, these skateboard still have a problem that riders cannot help but moving their bodies to generate propulsive force from rolling motion of both board.

DISCLOSURE OF INVENTION

Technical Problem

The present invention addresses the problems of skateboards in the related art described above, and it is an object of the present invention to provide a skateboard that can generate sufficient propulsive force only by small rolling operation of a front board and a rear board and provide a rider with more activity and interest, by disposing first and second propeller shafts in a hollow cover body disposed between the front board and the rear board such that they can elastically expand/contract straight by cam motion.

Further, it is another object of the present invention to make is possible to easily manufacture a skateboard and reduce the manufacturing cost by simplifying the parts. Furthermore, it is another object of the present invention to provide a skateboard that can be kept horizontal without breakdowns in traveling by forming a cam-shaped joint portion at one end of each of the first and second propeller shafts disposed in the hollow cover body.

Technical Solution

In order to achieve the objects of the present invention, a skateboard includes a front board and a rear board that are connected at a predetermined distance and casters fixed to the bottoms of the boards, in which a hollow cover body is fitted in assembly holes and of housings and formed beneath the bottoms of the front board and the rear board, a first propeller shaft fitted in the assembly hole at the front board and a second propeller shaft 60R fitted in the assembly board at the rear board are inserted in the hollow cover body in contact with each other by cam-shaped joint portions, and the first and second propeller shafts 60A and 60B horizontally and elastically expand/contract in rolling motion of the front board 30 and the rear board 40.

The joint portions of the first and second propeller shafts have a depressed portion and a protrusion facing each other to be engage with other, respectively, and the first and second propeller shafts are connected with a spring therebetween such that the first and second propeller shafts and are elastically spaced or return.

A groove where the spring is seated is formed in the first propeller shaft, a rod extending and protruding from the second propeller shaft is inserted in the groove, and the spring is fitted on the rod and fixed by a nut to provide elastic force between the first and second propeller shafts.

MODE FOR THE INVENTION

Figure 1:
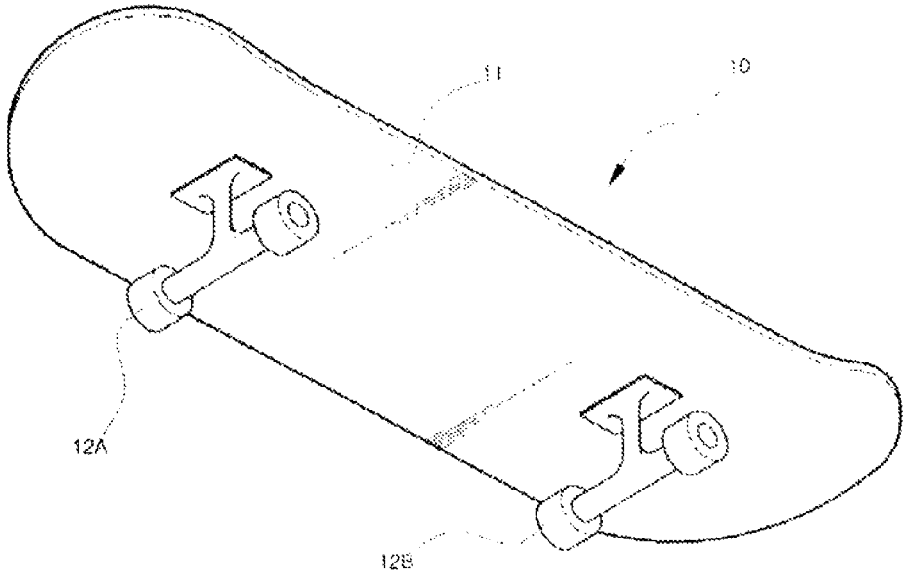
FIG. 1 PRIOR ART
FIG. 1 is a perspective view showing a skateboard in a related art.
Figure 2:
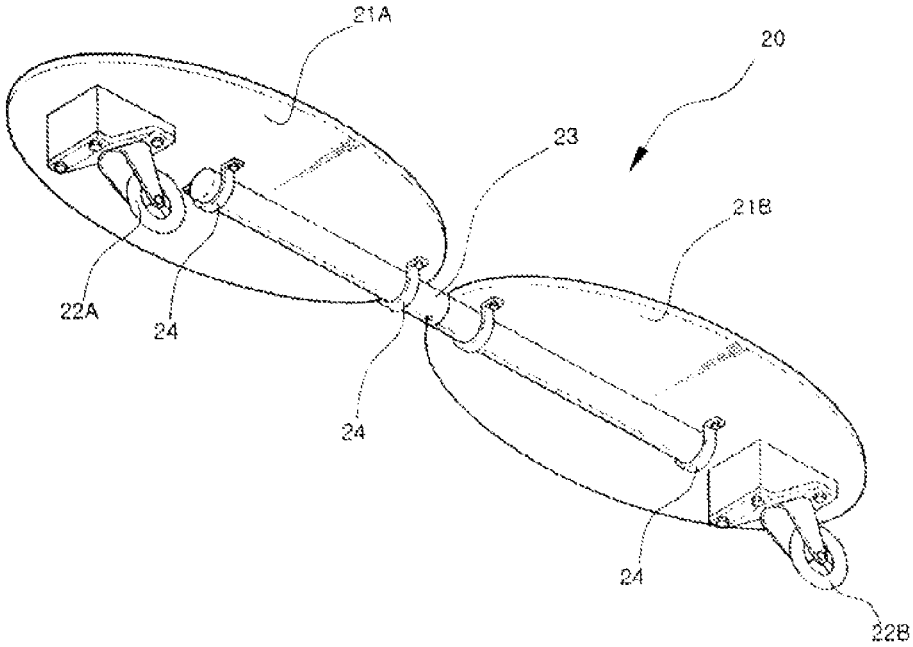
FIG. 2 PRIOR ART
FIG. 2 is a perspective view another exemplary configuration of a skateboard in the related art.
Figure 3:
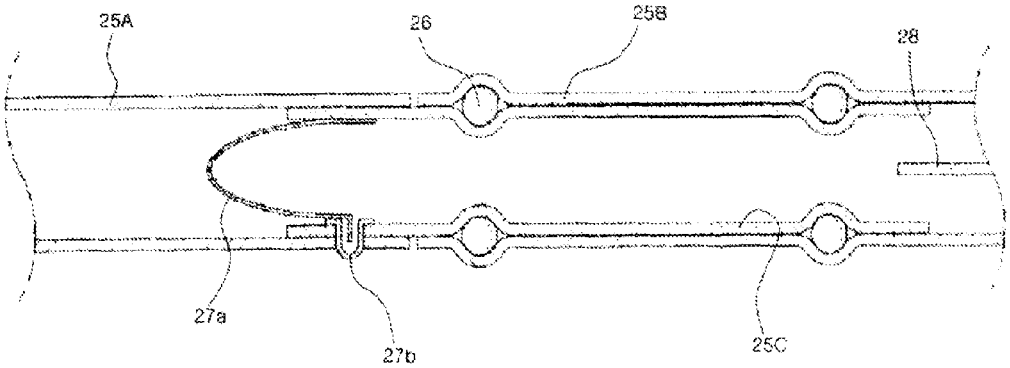
FIG. 3 PRIOR ART
FIGS. 3 and 4 are views the configuration of main parts of the skateboard shown in FIG. 2.
Figure 4:
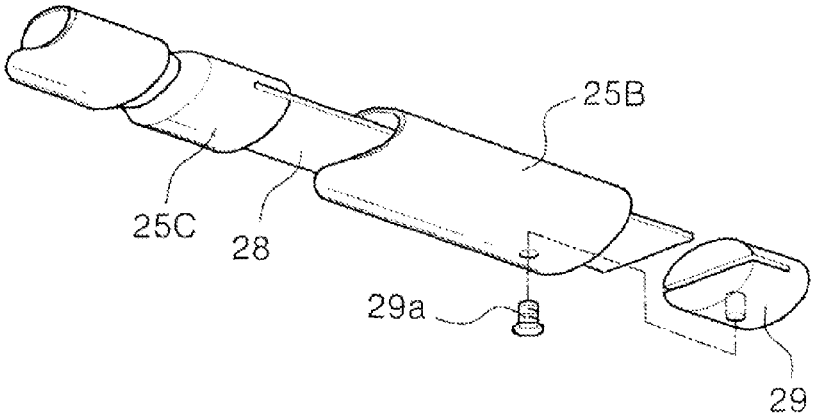
FIG. 4 PRIOR ART
Figure 5:
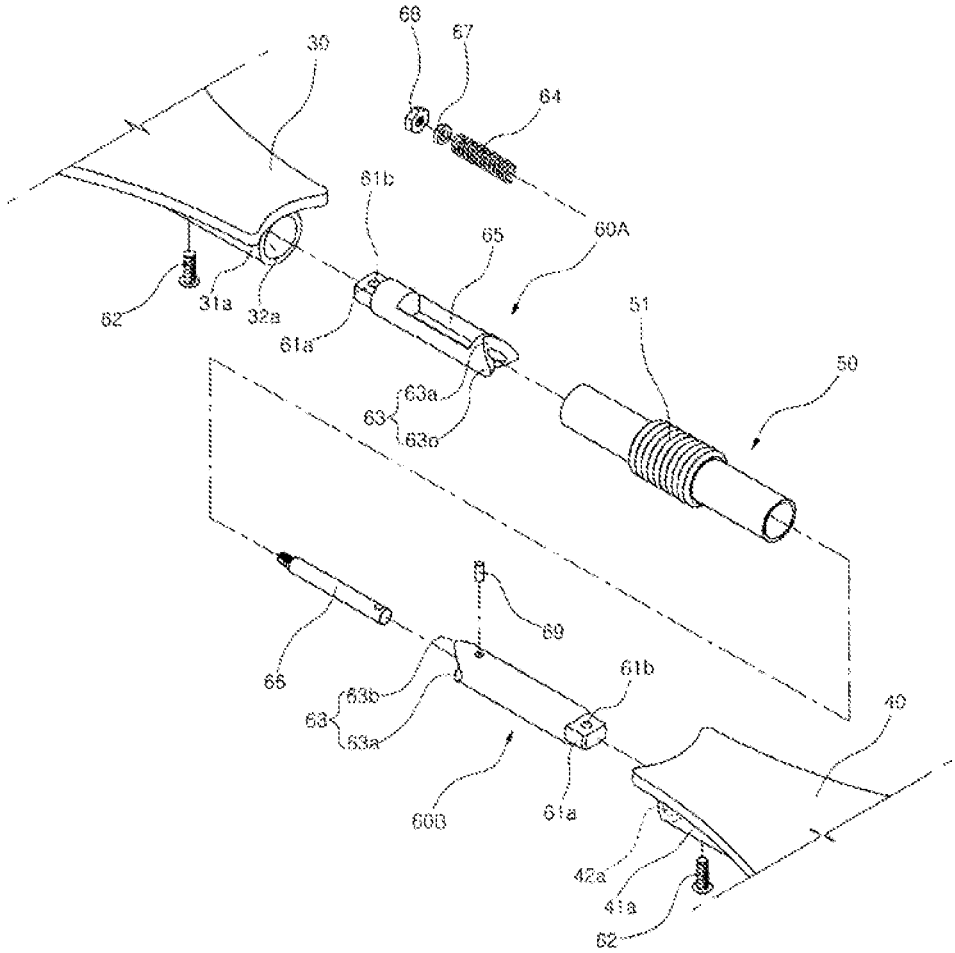
FIG. 5 is an exploded perspective view showing a skateboard according to the present invention.
Figure 6:
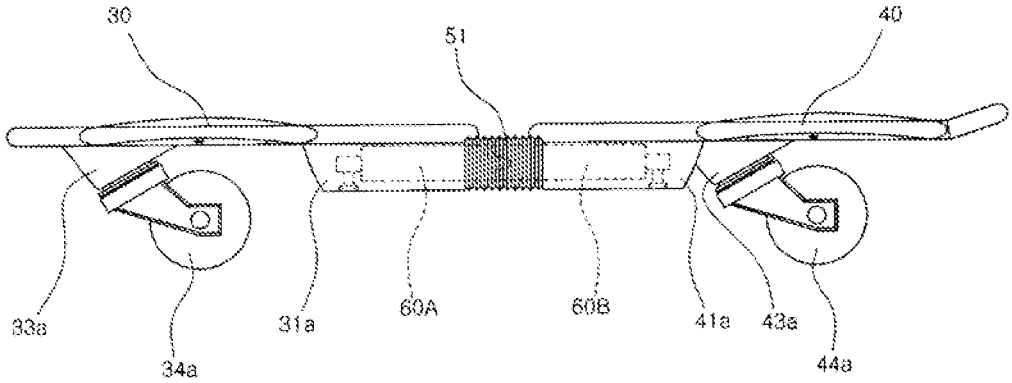
FIG. 6 is a side view showing when the parts shown in FIG. 5 are assembled.
Figure 7:
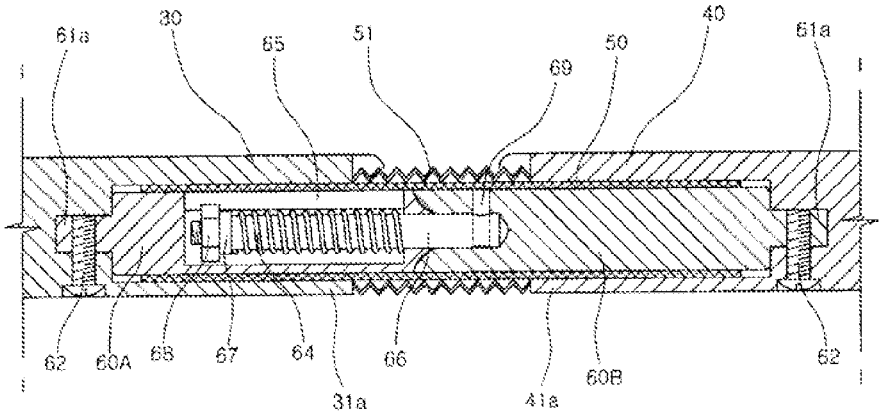
FIGS. 7 and 8 are cross-sectional view showing when the first and second propeller shafts shown in FIG. 5 are combined.
Figure 8:
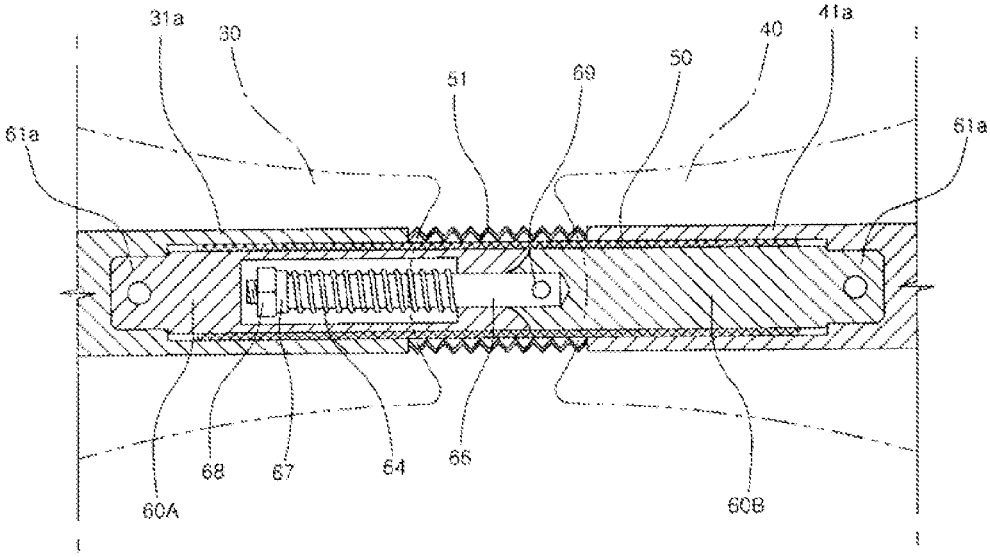

Preferred embodiments of the present invention is described hereafter in detail with reference to the accompanying drawings.

First. FIGS. 5 to 10 are views illustrating a skateboard according to the present invention. As shown in the figures, a front board 30 and a rear board 40 are separated and spaced apart from each other. Housings 31*a* and 41*a* are formed on the bottoms of the boards 30 and 40. A hollow cover body 50 is fitted in assembly holes 32*a* and 42*a* of the housings 31*a* and 41*a*. Separate first and second propeller shafts 60A and 60B are disposed in the hollow cover body 50.

With this configuration, forward traveling is possible by rolling motion applied to the boards 30 and 40. Supports 33*a* and 43*a* are fixed to the center portion of the bottoms of the boards 30 and 40 and common casters 34*a* and 44*a* that are free in rotation about shafts (not shown) are fixed to the inclined surfaces of the supports 33*a* and 43*a*, such that the boards can be turned.

An elastic pleated cover cap 51 is fitted on the outer circumferential surface of the hollow cover body 50 in consideration of the external appearance of the product. Accordingly, the hollow cover body 50 is not exposed between the boards 30 and 40.

Further, a bracket 61*a* is formed at the outside ends of the first and second propeller shafts 60A and 60B. A threaded-hole 61*b* is formed through the brackets 61*a*, such that the brackets 61*a* are inserted in the assembly holes 32*a* and 42*a* of the housings 31*a* and 41*a* and then fastened to the housings 31*a* and 41*a* by fixing bolts 62. The surfaces facing each other of the first and second propeller shafts 60A and 60B form joint portions 63 having a cam shape with a depressed portion 63*a* and a protrusion 63*b* facing each other.

The joint portions 63 are preferably integrally formed with the first and second propeller shafts 60A and 60B, but it should be noted that they can be formed to be combined after being separated.

The joint portions 63 of the first and second propeller shafts 60A and 60B are horizontally spaced or return in the rolling motion of the boards 30 and 40, and this expansion/contraction can be elastically achieved by a spring 64.

That is, a groove 65 where the spring 64 is seated is formed in the first propeller shaft 60A, a rod 66 disposed in the second propeller shaft 60B is inserted in the groove 65, and the spring 64 and a washer 67 is fitted on the rod 66 and fixed by a nut 68. Therefore, the spring 64 can provide elastic force between the first and second propeller shafts 60A and 60B.

In the figures, the rod 66 is fitted in the second propeller shaft 60B and fixed by a fixing pin 69. However, it can integrally extend from the second propeller shaft 60B.

According to the present invention having the above configuration, a rider can move forward the skateboard by pushing the ground with a support foot, with the other foot on the front board 30 to keep the boards 30 and 40 horizontal.

Thereafter, the rider completely rides on the skateboard by putting the support foot on the rear board 40, and then can move forward and turn the skateboard by making rolling motion with the feet.

Figure 9:
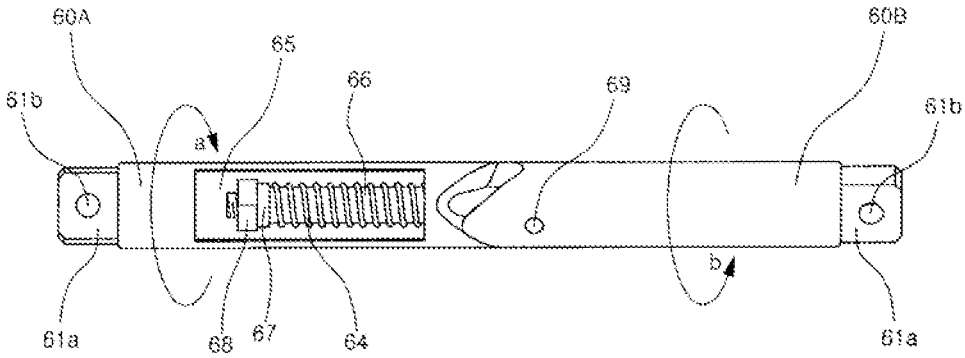
FIGS. 9 and 10 are views illustrating the operation of the first and second propeller shafts.
Figure 10:
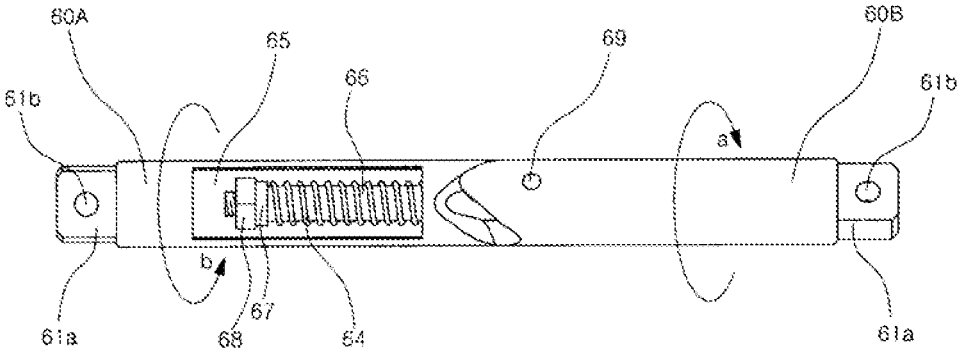

That is, when the rider generates rolling motion of the boards 30 and 40, as shown in FIGS. 9 and 10, the first and second propeller shafts 60A and 60B rotate in the opposite directions, as indicated by the arrows a and b.

Accordingly, the depressed portion 63*a* of the joint portion 63 of the first propeller shaft 60A is pushed by the protrusion 63*b* of the joint portion 63 of the second propeller shaft 60B and the spring 64 seated in the groove 65 of the first propeller shaft 60A is compressed.

Further, as the second propeller shaft 60B rotates in the opposite direction, the spring 64 is temporarily decompressed and the first propeller shaft 60A returns, and the protrusion 63*b* of the second propeller shaft 60B pushes again the first propeller shaft 60A.

Therefore, as the first propeller shaft 60A is repeatedly pushed by the cam operation of the depressed portions 63*a* and the protrusions 63*b* of the joint portions 63 of the first and second propeller shafts 60A and 60B, the front board 30 mounted on the first propeller shaft 60A receives forward horizontal propulsive force, such that it can be traveled quickly forward.

Further, the rider can easily turns the skateboard by rotating the boards 30 and 40 about the shafts of the casters 34*a* and 44*a* fixed to the supports 33*a* and 43*a* on the bottom of the boards 30 and 40.

The objects of the present invention can be accomplished by the technical configuration described above. Although the present invention was described with reference to the above embodiments and figures, it should be understood that the present invention is not limited thereto and can be changed and modified by those skilled in the art, within the spirit of the present invention and the equivalent range to claims described below.

Industrial Applicability

According the a skateboard having the above features of the present invention, since elastic straight expansion/contraction is performed between the front board and the rear board by the cam operation of the first and second propeller shafts disposed in the hollow cover body between the front board and the rear board, small rolling motion generates sufficient propulsive force, thereby providing a rider with more activity and interest.

Further, according to the present invention, since the first and second propeller shafts in the hollow cover body have a cam-shaped joint, the boards are always kept horizontal and a rider can easily ride on it. Further, it is possible to semipermanently use the skateboard without breakdowns, even if excessive force is applied by a rider while the skateboard travels. In addition, since the parts are simplified, productivity is improved and the corresponding cost can be reduced.

The invention claimed is:

1. A skateboard comprising a front board and a rear board that are connected at a predetermined distance and casters fixed to bottoms of the front and rear boards, wherein a hollow cover body is fitted in assembly holes of housings formed beneath the bottoms of the front board and the rear board, a first propeller shaft having a cam-shaped joint portion at one end thereof and fitted in the assembly hole at the front board and a second propeller shat having a cam-shaped joint portion at one end thereof and fitted in the assembly hole at the rear board are inserted in the hollow cover body in contact with each other by the cam-shaped joint portions, and the first and second propeller shafts horizontally and elastically expand/contract in rolling motion of the front board and the rear board.

2. A skateboard comprising a front board and a rear board that are connected at a predetermined distance and casters fixed to bottoms of the front arid rear boards, wherein a hollow cover body is fitted in assembly holes of housings formed beneath the bottoms of the front board and the rear board, a first propeller shaft fitted in the assembly hole at the front board and a second propeller shaft fitted in the assembly hole at the rear board are inserted in the hollow cover body in contact with each other by cam-shaped joint portions, and the first and second propeller shafts horizontally and elastically expand/contact in rolling motion of the front board and the rear board, and wherein the joint portion of each of the first and second propeller shafts has a depressed portion and a protrusion, the depressed portions and the protrusions of the first and second propeller shafts face each other to be engaged with each other, respectively, and the first and second propeller shafts are connected with a spring therebetween such that the first and second propeller shafts are elastically spaced or return.

3. The skateboard according to claim 2, wherein a groove where the spring is seated is formed in the first propeller shaft, a rod extending and protruding from the second propeller shaft is inserted in the groove, and the spring is fitted on the rod and fixed by a nut to provide elastic force between the first and second propeller shafts.

4. A skateboard comprising a front board and a rear board that are connected at a predetermined distance and casters fixed to bottoms of the front and rear boards, wherein a hollow cover body is fitted in assembly holes of housings formed beneath the bottoms of the front board and the rear board, a first propeller shaft fitted in the assembly hole at the front board and second propeller shaft fitted in the assembly hole at the rear board are inserted in the hollow cover body in contact with each other by cam-shaped joint portions, and the first and second propeller shafts horizontally and elastically expand/contract in rolling motion of the front board and the rear board, and wherein a groove where a spring is seated is formed in the first propeller shaft, a rod extending and protruding from the second propeller shaft is inserted in the groove, and the spring is fitted on the rod and fixed by a nut to provide elastic force between the first and second propeller shafts.

* * * * *